US007217317B1

(12) United States Patent
Bauer et al.

(10) Patent No.: US 7,217,317 B1
(45) Date of Patent: May 15, 2007

(54) DEVICE AND METHOD FOR THE SECURE CONVEYANCE AND HANDLING OF SPINNABLE CELLULOSE SOLUTIONS

(75) Inventors: Ralf-Uwe Bauer, Rudolstadt (DE); Enrico Brandt, Rudolstadt (DE)

(73) Assignee: Zimmer AG (DE)

( * ) Notice: Subject to any disclaimer, the term of this patent is extended or adjusted under 35 U.S.C. 154(b) by 721 days.

(21) Appl. No.: 10/332,492

(22) PCT Filed: Oct. 18, 2000

(86) PCT No.: PCT/DE00/03665

§ 371 (c)(1),
(2), (4) Date: May 22, 2003

(87) PCT Pub. No.: WO02/04718

PCT Pub. Date: Jan. 17, 2002

(30) Foreign Application Priority Data

Jul. 8, 2000 (DE) ..... 100 33 406

(51) Int. Cl.
*C08L 1/00* (2006.01)
*C09D 101/00* (2006.01)
*C09J 101/00* (2006.01)

(52) U.S. Cl. ..... 106/163.01; 264/40.1; 425/143

(58) Field of Classification Search ..... 106/163
See application file for complete search history.

(56) References Cited

U.S. PATENT DOCUMENTS 2,644,195 A * 7/1953 Bennes et al. ..... 264/37.26
4,177,105 A * 12/1979 Laakso et al. ..... 162/237
4,902,454 A * 2/1990 Steinbichler et al. ..... 264/40.6
5,401,304 A * 3/1995 Wykes et al. ..... 106/163.01
5,683,633 A * 11/1997 Liehr ..... 264/40.6
5,795,488 A * 8/1998 Kalt et al. ..... 210/767
6,350,614 B1 * 2/2002 Heath et al. ..... 436/55

FOREIGN PATENT DOCUMENTS

EP 0 668 941 B1 7/1996

OTHER PUBLICATIONS

Scheffel, "1000 Begriffe fur den Praktiker Automatische Steuerungen." 1998: p. 74.

* cited by examiner

*Primary Examiner*—David Sample
*Assistant Examiner*—Abraham M. Matthews
(74) *Attorney, Agent, or Firm*—Steven J. Hultquist; Intellectual Property/Technology Law

(57) ABSTRACT

Device and procedure for safely conveying and handling a cellulose solution suitable for manufacturing solvent-spun cellulose molded parts, in particular for manufacturing fibers, films and membranes, in devices for conveying and handling the spinnable cellulose solution, provided with a tempering device, wherein the temperature in the tempering system is reduced once the temperature in the cellulose solution has exceeded at least a first limiting temperature, as a result of which the temperature of the spinning solution drops and the reaction mixture is prevented from passing through. A procedure and device with two switching stages is also disclosed.

11 Claims, 1 Drawing Sheet

DEVICE AND METHOD FOR THE SECURE CONVEYANCE AND HANDLING OF SPINNABLE CELLULOSE SOLUTIONS

CROSS-REFERENCE TO RELATED APPLICATIONS

This application is filed under the provisions of 35 U.S.C. §371 and claims the priority of International Patent Application No. PCT/DE00/03665 filed Oct. 18, 2000, which in turn claims priority of German Patent Application No. 100 33 406.7 filed Jul. 8, 2000.

The invention relates to a device and procedure for safely conveying and handling a cellulose solution suitable for manufacturing solvent-spun cellulose molded parts, in particular for manufacturing fibers, films and membranes.

BACKGROUND OF THE INVENTION

Procedures for spinning cellulose solutions are known in the art. In this case, a cellulose solution comprising pretreated cellulose, a non-solvent for cellulose, such as water, along with a solvent for cellulose, such as tertiary amine oxide, in particular N-methyl morpholine-N-oxide, in addition to other spinning aids that might be necessary, are prepared to yield a spinnable solution, hereinafter referred to as spinning solution, wherein this mixture only retains its spinnability if kept at a temperature ranging from about 70° C. to 120° C. Spinnability is here the property of spinning the solution into molded parts in a dry-wet extrusion process. EP-A 0 574 870 describes the manufacture of cellulose molded parts out of such solutions, for example.

The above procedures offer clear advantages relative to other procedures for the manufacture of fibers, films and membranes. For example, they enable the manufacture of molded parts superior to conventional molded parts in many respects, such as viscose. The procedure also permits a continuous manufacture of molded parts. In addition, ecological advantages must be highlighted, since essentially no chemicals detrimental to the health or environment are used or precipitated in this procedure for manufacturing solvent-spun cellulose molded parts.

There are also disadvantages to the known procedures and devices for manufacturing solvent-spun cellulose molded parts. The mixtures consisting of cellulose, tertiary amine oxides and water tend to undergo vigorous decomposition reactions at high temperatures, so-called runaways. In addition, decomposition generally sets in after a variable induction period, so that the time and temperature of the runaway reaction are difficult to forecast in practice.

In general, the adiabatic induction period becomes shorter as the temperature of the mixture goes up. The correct selection of temperature and time parameters is pivotal for a safe manufacturing process.

On a production scale, an explosive runaway reaction in the mixture can be expected after about 16 hours for mixtures of cellulose, tertiary amine oxide and water if the mixture is kept at a temperature of about 115° C.

To maintain the spinning solution temperature at a level necessary for spinning in the conveying and handling equipment, e.g., spinning device, mixing container, supply container, lines and other equipment, the individual equipment components are provided with heaters. In this case, subdivision into sectors encompassing individual or several of the above components is a common practice.

Known in the art are various types of heaters that can be attached primarily, but not exclusively, to the outside of the above components. Electric heaters are known, for example. Also known are hot water heaters, in which the necessary warmth is imparted to the spinning solution via hot water streaming through pipes or double walls in the components.

Without wishing to be limited to a single theory, indications are made of an autocatalytic mechanism for the decomposition reaction. Small amounts of Fe(III) ions lead to a noticeable reduction in thermal stability. However, the idea of removing iron ions from the production mixture must be rejected for economic considerations.

The problem involving the spontaneous and explosive decomposition of the mixture requires that special protective measures be taken to prevent serious accidents, and to protect both the equipment for conveying and handling the spinnable cellulose solution, hereinafter called conveying equipment, and personnel, or safeguard them against serious damage or injury.

In prior art, the conveying equipment or its assemblies are provided with conventional and cost-intensive safety devices. These safety devices involve bursting devices that are incorporated at selected locations. Expansion rooms or expansion containers are also used to hold the expanding spinning solution. Such conventional safety devices are not only cost-intensive, but also restricted exclusively in their action to limiting the effects of the spinnable cellulose solution as it passes through so that the conveying equipment is not destroyed. At the same time, the safety of operating personnel is also ensured.

A process for the manufacture of solvent spun cellulose fibres is known from the U.S. Pat. No. 5,401,304, involving transport of the cellulose solution through pipes, whereby an exothermic runaway of the cellulose solution essentially is controlled through regulation of the temperature of the transported solution in dependence of the diameter of the pipe.

The Temperature of the Cellulose solution ist controlled by equipping the pipe with a hollow jacket, containing a circulating heat transfer fluid. At exceeding a limit temperature of the solution to be transported the flow rate is increased or the temperature of the heat transfer fluid is lowered. The temperature of the heat transfer fluid is regulated by a heat exchanger.

Therefore, the disadvantage to the safety devices in prior art is that their action is restricted to limiting the effects of the spinning solution as it passes through, and not limiting the passage of the spinning solution itself.

SUMMARY OF THE INVENTION

The object of this invention is to overcome the disadvantages to prior art and provide a safety device and procedure that prevents the production mixture from passing through.

Another object of this invention is to provide a safety device and procedure for manufacturing solvent-spun cellulose molded parts that prevents the spinnable cellulose solution from passing through, without having any disruptive influence on the conveying, handling and production process, e.g., unnecessarily having to interrupt the production process.

The objects are achieved via the technical features set fort in the independent claims. The subclaims describe preferred embodiments.

DESCRIPTION OF THE INVENTION

Figure 1:
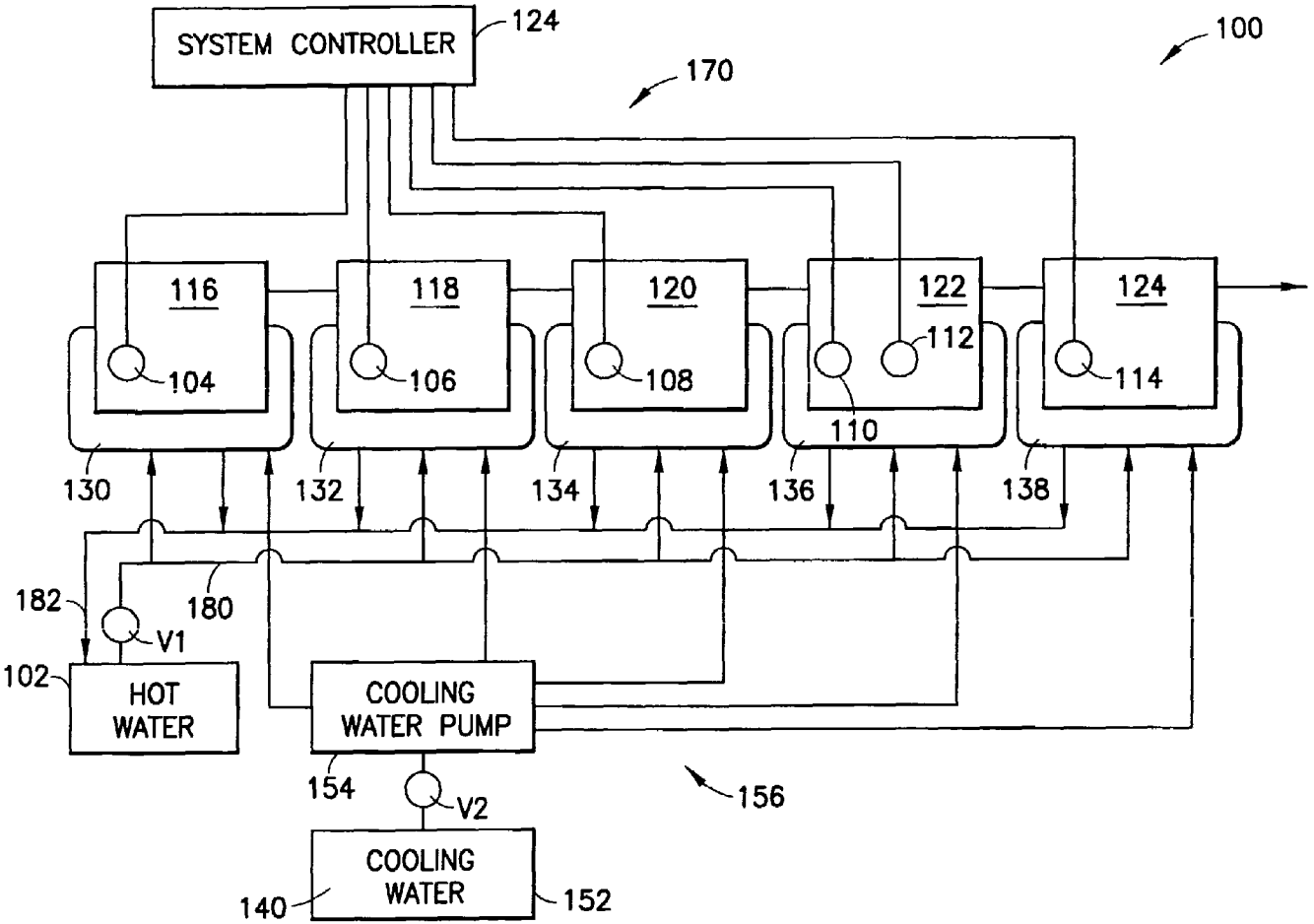
FIG. 1 is a schematic illustration of a production system for manufacturing solvent-spun cellulose molded parts.

The invention is based on the knowledge that a localized overheating of a limited quantity of spinning solution does not directly result in the entire system being passed through. In addition, it is based on the knowledge that a uniformly high temperature level in the entire system, or at least in a sufficiently large volume, is necessary for the substances or mixture to pass through.

Based on known production equipment for manufacturing solvent-spun cellulose molded parts with hot water heating equipment as the tempering system, this invention prevents the spinning solution from passing through by continuously monitoring the temperature of the spinning solution in the individual sectors or assemblies of the devices and, depending on preset parameters, decreasing the temperature of the hot water of the heating equipment and/or feeding cooling water into the heating equipment.

This trick of the trade drops the temperature of the spinning solution to a point where the spinning solution can no longer pass through. In a preferred embodiment, the temperature of the spinning solution is kept at a point where it does not dip below the minimum temperature necessary for the spinning process, thereby advantageously both preventing the danger of the spinning solution passing through while simultaneously not interrupting the production process.

Furthermore according to the invention, the temperature of the hot water in the heating equipment is reduced and cooling water is supplied to the heating equipment distribution system in stages.

In the first stage, the temperature of the hot water in the heating equipment is continuously decreased when a first preset limiting temperature of the spinning solution is exceeded, wherein the temperature of the hot water dips below the temperature of the spinning solution to achieve a relative cooling, i.e., temperature drop, of the spinning solution with the associated heat transfer from the spinning solution to the hot water. The temperature of the hot water can be reduced with basically known measures, such as by using heat exchangers. The hot water in the heating system can also be partially supplied with cooling water. However, the latter step does not enable the recovery of process warmth.

If the measures taken in the first stage are successful and the temperature of the spinning solution returns to the preset, desired temperature range for the spinning process, the safety process has ended, and the companion heating system is operated in its normal technological regime.

If the measures in the first stage fail to bring the temperature of the spinning solution to the specified desired temperature range and the temperature of the spinning solution exceeds a second preset limiting temperature exceeding the first preset limiting temperature, the measures of the second stage of the safety procedure according to the invention are initiated.

The measures of the second stage in the safety procedure are also initiated if the temperature in the spinning solution rises so fast as to exceed the second preset limiting temperature before the measures in the first stage can be introduced or take effect.

In the second stage of the procedure, the introduction of hot water into the heating system is essentially interrupted, and cooling water is fed into the distribution system of the heating system. The cooling water has a temperature lying clearly below the temperature of the hot water, even in as far as the hot water temperature was modified through the measures taken in the first stage.

While no significant limitations are placed on the selection of cooling water temperature, it must be remembered that the cooling water temperature should be low enough to enable as much heat dissipation from the spinning solution as possible, and hence prevent the spinning solution from passing through, and that the cooling water temperature must be high enough to prevent the thermal stress of the production equipment and/or distribution system from rising above a level that would damage the distribution system or other parts of the production equipment. Such damages can include stress cracks owing to the temperature change, for example.

The expert can, based on his or her specialized knowledge, or through simple commonly and reasonably known from technical practice, determine the temperature of the cooling water at which its introduction will not damage the production equipment, while simultaneously ensuring a sufficient heat dissipation from the spinning solution. A suitable cooling water temperature measures 20° C.

The above measures can be introduced in such a way as to have the procedure according to the invention affect either the entire production facility or just individual groups, i.e., spinning device, mixing container, storage tanks, supply lines and other parts.

In the following, the invention will be described in greater detail based on an example.

FIG. 1 is a schematic representation of a conventional production system 100 for manufacturing solvent-spun cellulose molded parts out of a cellulose consisting of pretreated cellulose, a non-solvent for cellulose and a solvent for cellulose, equipped with a hot water heating system 102 was provided with temperature sensors 104, 106, 108, 110, 112 and 114 for measuring the spinning solution temperature. In this case, the system is divided into individual sectors, e.g., pipe sections 116, mixing vessels 118, extruders 120 and other parts 122 and 124, which each receive quantities of spinning solution sufficient cause the spinning solution to pass through. At least one temperature sensor is arranged in each of the sectors set up in this way.

To increase safety, several sensors 110, 112 can be arranged in a sector 122. Preferably, the temperature sensors consist of so-called dual sensors. Dual sensors comprise two temperature sensors that measure the temperature of the spending solution at nearly the same location, and relay a temperature signal to the system controller 124, wherein the temperature sensors of this sensor pair additionally compare the measuring results, and issue a separate signal given deviations in the measuring results. The separate signal, also called a defect signal, alerts the system controller to the failure of a temperature sensor. In this embodiment, the system controller 124 is connected by a safety circuit (not shown) with the individual companion heating systems 130, 132, 134, 136 and 138, which can be automatically deactivated by the system controller 124 in response to a defect signal. The embodiment of this invention with dual temperature sensors further enhances safety. Suitable temperature sensors are commercially available under the designation PT-100.

Measuring sensors detect a localized overheating of the spinning solution in at least one of the sectors, and the temperature values are relayed to the safety circuit 170. The preset parameters of the first limiting temperature and the second limiting temperature are provided as switching points in the safety circuit. The cited parameters are variable, and set as a function of the used spinning solution.

In the present example, a first limiting temperature of 98° C. was sent as the first switching point. When the spinning solution temperature exceeded the first switching point, the heat exchanger power was increased by switching the flow rate of cooling water through the heat exchanger to maximum.

As a result, the hot water temperature of the companion heater 136 was reduced, and the cooled quantity of water in the companion heater triggered a heat transfer between the locally overheated spinning solution and the now cooler hot water. After the preset and desired temperature profile of the spinning solution has been established, this safety setting could be acknowledged, both automatically and manually, and the companion heater 136 was adapted to the normal technological regime.

A second limiting temperature of 100° C. was provided as the second switching point. This switching point is reached when the measure do not take hold after reaching the first switching point.

Once the second switching point was reached or exceeded, the supply of hot water to the tempering system was terminated, while the hot water was discharged and cooling water was fed in.

In the present example, the second switching point triggered an automatic switching of two three-way valves V1 and V2. A separate emergency cooling water system 140 was incorporated into the affected heating system via the altered ball valve setting. The emergency cooling water system consists of a cooling water tank 152, a pressure-controlled conveyor pump 154 and the distribution system 156. In a normal state, the emergency cooling water system was under a prescribed system pressure. The conveyer pump was switched via a pressure membrane to keep the set system temperature constant.

Switching the three-way ball valves triggered a pressure drop in the cooling water system 140, as a result of which the conveyor pump 154 of the cooling water system was switched. The cooling water supplied via the conveyer pump 154 forced the warm water into the hot water system, wherein the supply of cold water (20° C.) cooled the temperature of the spinning solution in the affected sectors.

After the technological standard values were reached, the safety setting of the three-way ball valves and hot water heating system was again enabled. This can be done both manually and automatically.

In the FIG. 1 system, the hot water is fed to the individual sectors by a manifold line 180 having the three-way ball valve V1 therein, and recirculated hot water is returned to the hot water heating system by a manifold line 182, as illustrated. The cooling water tank 152 is joined to the cooling water pump 154 by a line containing a three-way valve V2 therein.

The invention claimed is:

1. A method for safely conveying and handling a spinnable cellulose solution comprising cellulose, a solvent for cellulose, and a non-solvent for cellulose at a specified temperature range of from about 70° C. to about 100° C. in a device equipped with a tempering system, wherein the tempering system includes hot water, the method comprising:

controlling heat dissipation from the spinnable cellulose solution in at least one sector of the device containing the spinnable cellulose solution when the temperature of the spinnable cellulose solution reaches or exceeds a switching point with a preset temperature value by providing a first and second switching point whereby the second switching point is set at a second preset temperature, which exceeds a first preset temperature of the first switching point, and wherein when the temperature of the spinnable cellulose solution has reached or exceeded the first switching point, the temperature of the hot water in the tempering system is reduced and if the temperature of the spinnable cellulose solution is not brought into the specified range of from about 70° C. to about 100° C. and the temperature of the spinnable cellulose solution has reached or exceeded the second switching point, an emergency cooling system of the tempering system is activated and an amount of up to all of the hot water in the tempering system is replaced with fresh water at a temperature to bring the spinning solution into the specified range of from about 70° C. to about 100° C., to prevent exothermic breakdown of the spinnable cellulose solution.

2. The method according to claim 1, further comprising monitoring the temperature continuously.

3. The method according to claim 1, wherein the emergency cooling system of the tempering system cools the hot water in the tempering system by cooling the hot water via a heat exchanger.

4. The method according to claim 1, wherein the emergency cooling system is enabled by starting pumps in the event of an internal pressure drop therein.

5. A device for safely conveying and handling spinnable cellulose solutions comprising cellulose, a solvent for cellulose, and a non-solvent for cellulose at a temperature ranging from about 70° C. to about 100° C. in the device equipped with a tempering system, the device comprising:

at least one sector having sufficient volume to allow the spinning solution to pass therethrough;

at least one temperature sensor arranged in the at least one sector of the device;

a safety circuit having at least a first and second switching point defined by a first and second limiting temperature;

a hot water heating system for heating the spinning solution as it passes through the at least one sector;

means for temperature reduction in fluid connection to the hot water heating system for reducing the hot water temperature in the hot water system, wherein the safety circuit is communicatively wired to the at least one temperature sensor and means for temperature reduction in such a way that, when the temperature of the spinnable cellulose solution in the sector has reached or exceeded the first limiting temperature, the means for temperature reduction is activated to reduce the temperature of the hot water in the hot water system to reduce the temperature of the spinning cellulose solution passing through the sector; and an emergency cooling system in fluid connection with the hot water heating system and communicatively wired to the safety circuit, wherein the emergency cooling system is activated to replace the water in the hot water heating system with cooler water when the temperature in the spinning cellulose solution reaches the second limitation temperature, to prevent exothermic breakdown of the spinnable cellulose solution.

6. The device according to claim 5, wherein the safety circuit is wired in such a way that, when the first limiting temperature in a sector has been reached or exceeded, the temperature of the hot water in the entire device is reduced.

7. The device according to claim 5, wherein the emergency cooling water system encompasses a storage water tank, a membrane-controlled conveyor pump and switching fittings, wherein the conveyor pump is actuated in such a way that an internal pressure drop in the emergency cooling water system caused by the switching of fittings triggers the conveyor pump.

8. The device according to claim 5, comprising more than one temperature sensor, wherein the temperature sensors are dual sensors wired in such a way that a defect signal is relayed to the safety circuit if one of the temperature sensors fails.

9. The device according to claim 8, comprising more than one sector, wherein the safety circuit is actuated in such a way as to deactivate the heating device at least in an affected sector on receipt of the defect signal.

10. The method according to claim 1, wherein the fresh water is at a temperature of about 20° C.

11. The method according to claim 1, wherein the temperature of fluid flowing through the hot water system dips below the temperature of the spinnable cellulose to achieve a relative cooling.

* * * * *